United States Patent [19]

Caruso

[11] 4,044,929

[45] Aug. 30, 1977

[54] HOLSTER BELT

[76] Inventor: Albert P. Caruso, 147 Broadmoor Drive, Tonawanda, N.Y. 14150

[21] Appl. No.: 411,035

[22] Filed: Oct. 30, 1973

[51] Int. Cl.[2] ..... F41C 33/02

[52] U.S. Cl. ..... 224/2 B; 224/5 A

[58] Field of Search ..... 224/2 B, 2 F, 2 D, 2 E, 224/26 B, 26 R, 5 A, 5 R, 5 L, 5 MC, 26 C, 22, 23

[56] References Cited

U.S. PATENT DOCUMENTS

| | | | |
|---|---|---|---|
| 1,747,454 | 2/1930 | Mees | 224/2 B |
| 2,434,380 | 1/1948 | Williams | 224/2 B |
| 2,753,100 | 7/1956 | Montgomery | 224/5 A X |
| 2,810,132 | 10/1957 | Nicholson | 224/2 B X |
| 2,917,214 | 12/1959 | Resnick | 224/2.2 |
| 2,970,727 | 2/1961 | Bohlin | 224/2 B |
| 2,995,282 | 8/1961 | Wells et al. | 224/26 R |
| 3,227,337 | 1/1966 | Santo, Jr. | 224/2 B |
| 3,300,109 | 1/1967 | Clark | 224/2.2 |
| 3,627,181 | 12/1971 | Bianchi | 224/22 X |
| 3,713,299 | 1/1973 | Duncan | 224/5 R X |

FOREIGN PATENT DOCUMENTS

| | | | |
|---|---|---|---|
| 1,387,748 | 12/1964 | France | 224/5 R |

OTHER PUBLICATIONS

R. and N. Simons; Catalogue 1961, Publication; *Legace Ankle Holster*; Chicago, Ill.

*Primary Examiner*—Robert B. Reeves
*Assistant Examiner*—Charles A. Marmor
*Attorney, Agent, or Firm*—Joseph P. Gastel

[57] ABSTRACT

A holster belt comprising an elongated belt member for encircling the waist of the wearer, band means, converging lines of stitching for fastening a band of substantially the same width as the belt member to the inside of the belt member to define a pocket for receiving a side arm therein, one of the lines of stitching being curved to provide a concave depression for the trigger guard of the side arm, and an adjustable buckle mounted on the end of the belt for varying the circumferential position of the pocket on the wearer.

13 Claims, 9 Drawing Figures

Fig. 1.
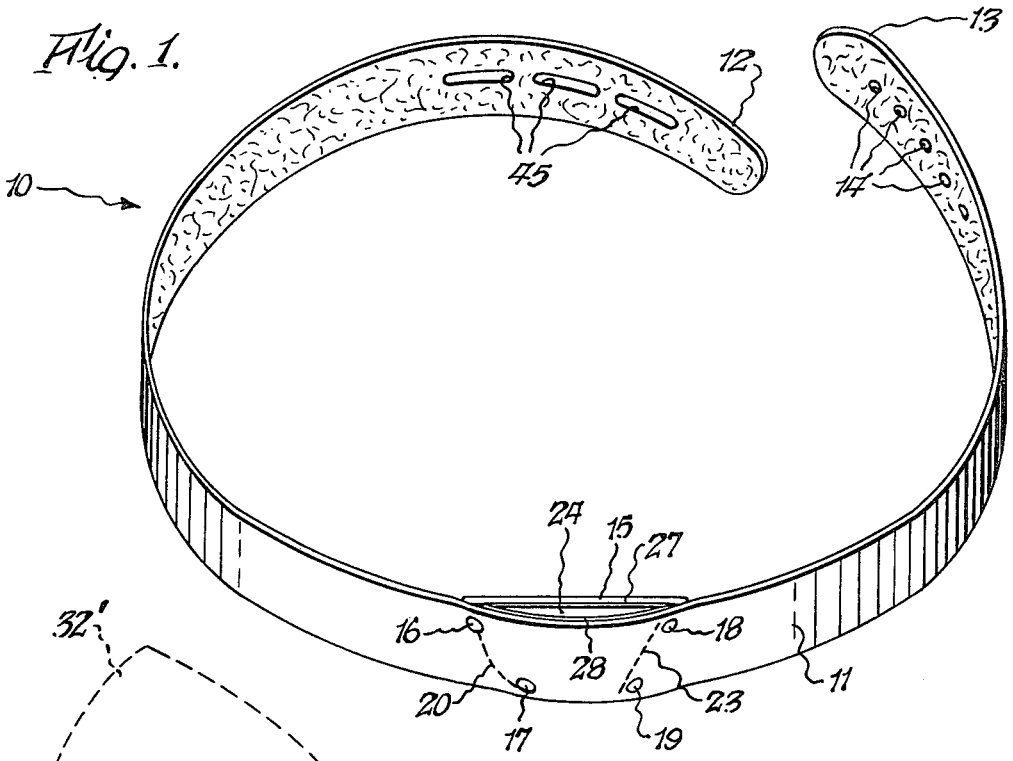
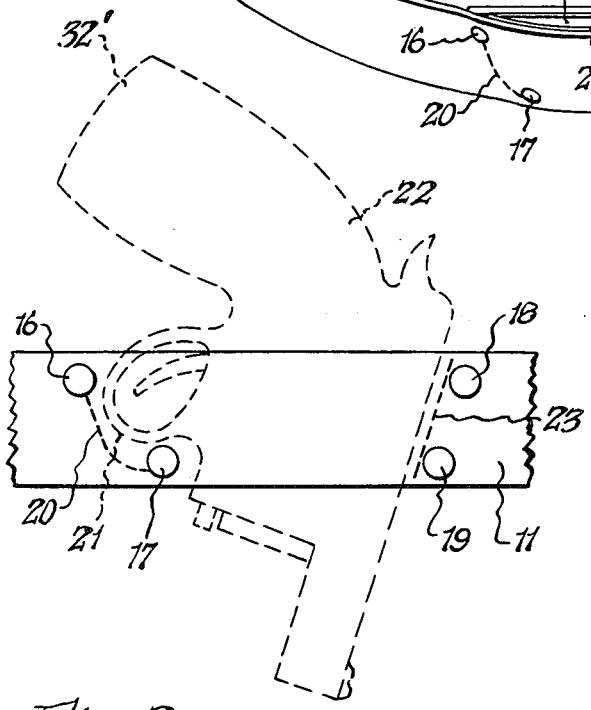
Fig. 2.
Fig. 3.
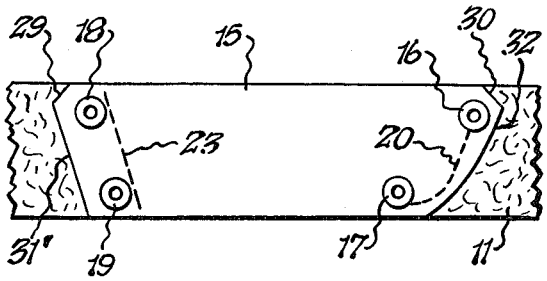
Fig. 4.
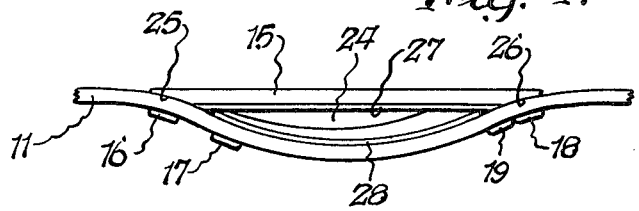
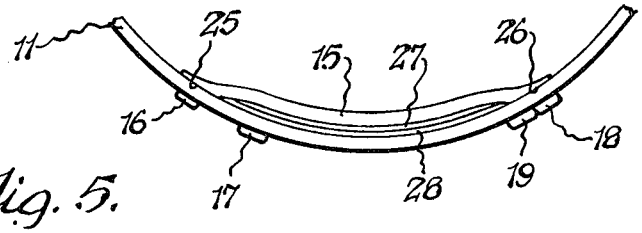
Fig. 5.

HOLSTER BELT

The present invention relates to an improved holster for carrying side arms and more particularly to an improved holster belt.

It is one object of the present invention to provide a combined belt and holster which can be used as an ordinary belt by merely removing the side arm from the holster portion thereof without the holster portion being discernible for all practical purposes.

Another object of the present invention is to provide an improved holster belt which carries a side arm snugly against the body of the wearer thereby providing a high degree of safety against the side arm being inadvertently snagged on foreign objects.

A further object of the present invention is to provide an improved holster belt which carries a side arm with a high degree of concealment, because it is held snugly against the body of the wearer whereby the side arm will not protrude appreciably and produce undesirable bulges under the clothing of the wearer.

Yet another object of the present invention is to provide an improved holster belt which will be comfortable to the wearer while still carrying the side arm snugly against the wearer's body in an extremely safe condition. A related object of the present invention is to provide an improved holster belt which will substantially shield the trigger of a side arm against accidental contact while permitting the remainder of the side arm to be exposed for ready access.

Still another object of the present invention is to provide an improved holster belt which is practically universal in that one type of holster can receive and carry a very large variety of different side arms. Other objects and attendant advantages of the present invention will readily be perceived hereafter.

The improved holster belt of the present invention comprises an elongated belt member for encircling the waist of the wearer, band means, and attaching means fixedly attaching spaced portions of said band means to said belt member to define a pocket therewith to receive a side arm therein. Preferably the attaching means are of a configuration to cause said pocket to approximate a trapezoid in side elevation and preferably the band means is mounted on the side of the belt member which faces the body of the wearer so that the holster portion of the holster belt is practically imperceptible when a side arm is not carried therein.

The various aspects of the present invention will be more fully understood when the following portions of the specification are read in conjunction with the accompanying drawings wherein:

FIG. 1 is a perspective view of the improved holster belt of the present invention without the buckle attached;

FIG. 2 is a fragmentary side elevational view of the portion of the belt which includes the holster, this view being taken from the outside of the belt;

FIG. 3 is a fragmentary side elevational view of the holster portion of the belt taken from the inside of the belt;

FIG. 4 is a fragmentary plan view of the holster portion of the belt when the portions of the belt on opposite sides of the holster portion are stretched to lie in a straight line;

FIG. 5 is a fragmentary plan view of the holster portion of the belt showing the position it assumes when it is in encircling relationship to a wearer;

Figure 6:
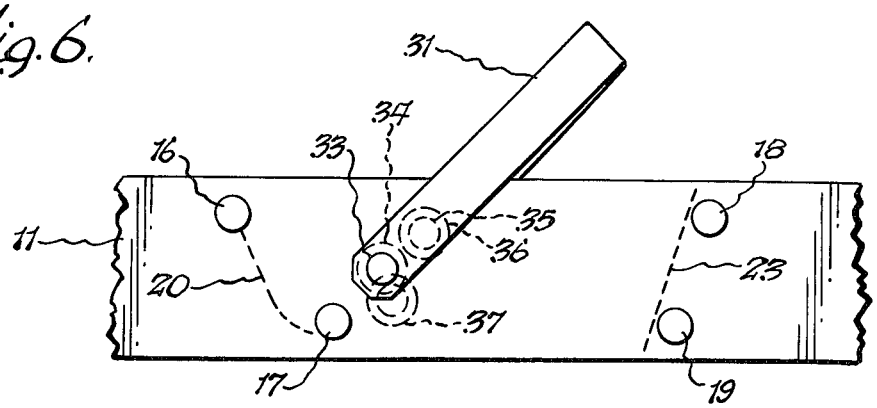
FIG. 6 is a side elevational view of a modified holster belt taken from the outside of the holster portion of the belt and showing a safety strap in position thereon.

The improved holster belt 10 of the present invention includes a belt member 11 comprising an elongated band of leather which is intended to encircle the waist of a wearer. The belt member 11 includes a first end portion 12 which is constructed to mount a buckle, as described in greater detail hereafter, and a second end portion 13 which includes a plurality of apertures 14 for receiving the tongue of the buckle. Belt member 11 may be fabricated of any suitable material, preferably leather, or of synthetic leather or fabric.

In order to provide a holster on belt member 11, a leather band 15, which is substantially trapezoidal in shape (FIG. 3) and which is of substantially the same width as belt member 11, is suitably affixed to belt member 11, preferably to the inside surface thereof. In this respect, rivets 16 and 17 fasten one end of band 15 to belt member 11 and rivets 18 and 19 fasten the other end of band 15 to belt member 11. Rows of stitching 20 and 23 also join belt member 11 and band 15. Line of stitching 20 is curved and extends as shown between rivets 16 and 17 to provide a concave depression for receiving trigger quard 21 of firearm 22 in complementary mating relationship. Rivet 17 is preferably located below the trigger quard so that it provides a firm support therefor. Line of stitching 23 is straight and extends substantially between rivets 18 and 19, as shown, line of stitching 23 being inclined relative to the longitudinal axis of belt member 11 so as to provide a border which is substantially parallel to the upper portion of side arm 22. Line of stitching 23 causes the side arm to assume an inclined attitude, as shown in FIG. 2, so as to minimize jabbing of the ends of the firearm into the body of the wearer. In essence, lines of stitching 20 and 23 converge in a downward direction. It will be appreciated that the positions of lines of stitching may be reversed if it is desired to support firearm 22 in an opposite direction to that shown in FIG. 2. It will be appreciated that any suitable type of securing means which may or may not include stitching and rivets may be used to secure band 15 to belt member 11.

Essentially the structure including the lines of stitching 20 and 23 provide a broadly trapezoidal pocket or loop for receiving side arm 22 so that it will be held firmly between band 15 and belt member 11 adjacent thereto. The trapezoidal pocket or loop 24 receives the side arm with a wedge fit so that it will not pop upwardly out from pocket 24. Furthermore, as it is quite apparent from the above description, the side arm 22 cannot drop downwardly out of the pocket because the bottom opening of the pocket is smaller than the larger portions of the side arm.

As can best be seen from FIGS. 4 and 5, the ends 25 and 26 of band 15 are skived to provide a tapered edge for approximately one-half inch along the entire end portions 31 and 32 so as to cause these end portions of band 15 to merge gradually with belt portion 11 to which they are attached. This obviates any undesirable protuberances on the inside of the belt portion 11 which may be a source of discomfort to the wearer. It is further to be noted from FIG. 4 that the length of band 15 between rows of stitching 20 and 23 is shorter than the length of the portion of belt member 11 between corresponding points on rows of stitching 20 and 23. Because of this relationship, the portion of belt member 11 between the rows of stitching will stand away from band 15 when the belt member 11 is stretched straight as shown in FIG. 4. However, when belt member 11 is caused to form an arc, as it does when in place on the waist of a wearer, band 15 and the portion of belt member 11 adjacent thereto, will nest against each other while both of them tend to lie in complementary mating relationship with the wearer's waist. This construction causes the side arm 22 to be held snugly in the holster pocket or loop 24 while affording the wearer a high degree of comfort. Linings 27 and 28 of suede or other soft material are suitably attached in facing relationship to each other on band 15 and belt member 11 on opposite sides of pocket 24 so as to provide a nonmarring surface within pocket 24. The upper ends 29 and 30 of band sides 31' and 32, respectively, are clipped as shown in FIG. 3, so as to eliminate any undesirable points which may snag on foreign objects.

Figure 7:
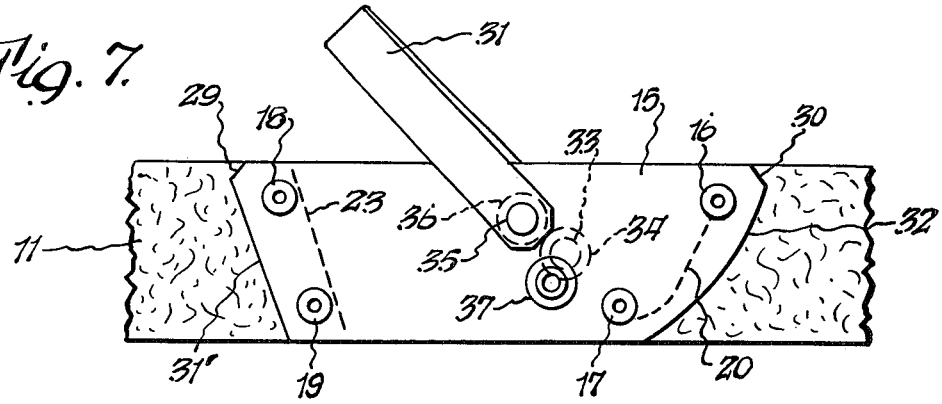
FIG. 7 is a fragmentary side elevational view taken from the inside of the belt of FIG. 6 and showing the adjustable mounting for the safety strap.

As can be seen from FIGS. 6 and 7, a strap 31 may be provided for overlying the handle portion 32' of the side arm to securely retain it in position, although this is not absolutely necessary but provides a factor of safety. Strap 31 includes a snap fastener 33 at one end thereof which snaps onto mating fastener portion 34 mounted on belt member 11. The other end of strap 31 includes a snap fastener 35 which snaps onto snap fastener portion 36 mounted on band 15. A second snap fastener portion 37 for receiving snap fastener 35 is also mounted on band 15. Therefore, by selecting which of snap fastener portions, 36 or 37, to which snap fastener 35 is attached, the effective length of strap 31 may be varied so that it will function satisfactorily with different sizes of side arms. Strap 31 is preferably made of leather but may also be made of fabric or may be made of elastic material or may include a leather portion with an elastic insert so as to make the entire band stretchable. In using the modification of FIGS. 6 and 7, snap fastener 33 is detached, the firearm 22 is inserted into pocket 24, and thereafter snap fastener 33 is reattached to snap fastener portion 34.

Figure 8:
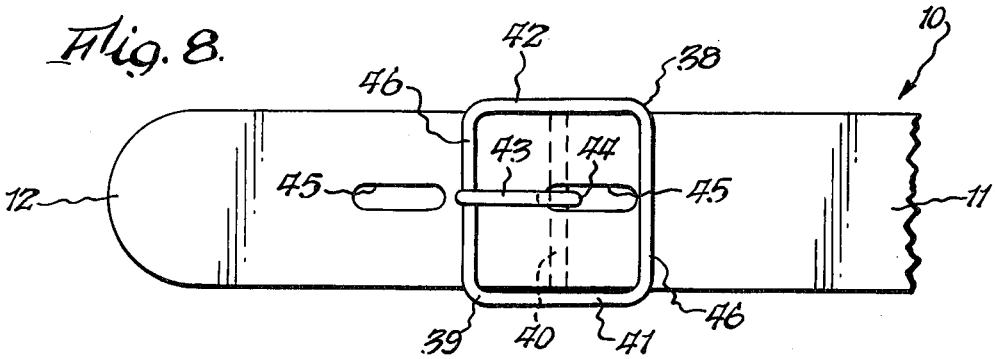
FIG. 8 is a fragmentary side elevational view showing the manner in which a buckle may be adjustably mounted on the end of the holster belt shown in FIG. 1.

One type of buckle 38 which may be used with belt 10 is shown in FIG. 8. This type of buckle includes a continuous metal loop 39 with a central bar 40 connecting opposite sides 41 and 42 of the buckle. A tongue 43 has a loop formed at end 44 which encircles bar 40. The buckle is mounted on end 12 of the belt member 11 with tongue 43 extending through one of the plurality of elongated apertures 45 in end 12 of the belt. Bar 40 lies in abutting relationship to the inside surface of belt member 11 and buckle ends 46, which connect buckle sides 41 and 42, lie on the outside surface of belt member 11. The end 13 of belt 10 is threaded through belt buckle 38 in the conventional manner so that tongue 43 will be received in any of apertures 14, depending on the size of the waist of the wearer.

It is to be noted that the reason for providing a plurality of elongated apertures 45 for selectively receiving tongue 43 of buckle 38 is to adjust the position at which pocket 24 is located relative to the wearer. In this respect, if it is desired that pocket 24 be located close to the hip, the buckle will be mounted at the aperture 45 closest to the end of the belt portion 11. However, if it is desired that pocket 24 be located more around the back of the wearer, the buckle 41 will be mounted in any of the apertures 45 which are further away from the end of belt member 11.

Figure 9:
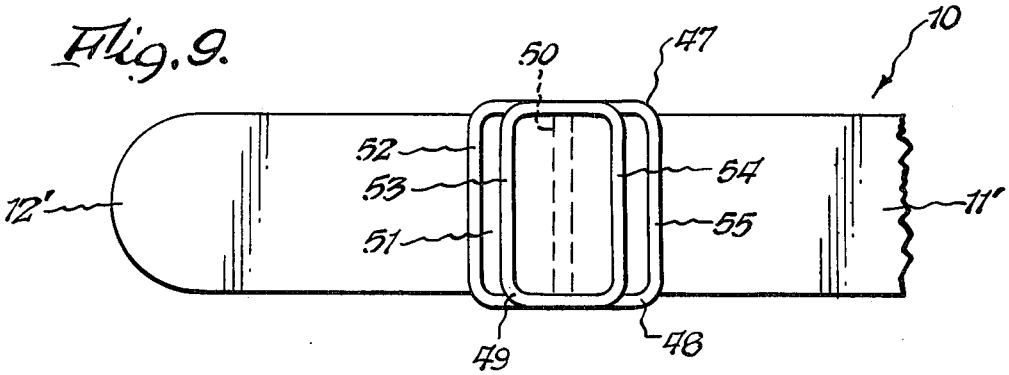
FIG. 9 is a fragmentary side elevational view showing the manner in which a slide or friction buckle may be mounted on the end of the holster belt in order to provide adjustability thereto.

Another type of belt buckle 47 which may be used is shown in FIG. 9. This belt buckle is of the sliding or friction type which does not require apertures such as 45 shown in FIGS. 1 and 8. Therefore belt member 11' having an end 12' can be identical in all respects to the belt shown in FIG. 1 except that apertures 45 have been omitted and that apertures 14 have also been omitted because the buckle 47 does not possess a tongue. More specifically, buckle 47 includes an outer loop 48 and an inner loop 49 secured on loop 48, with both loops being secured to bar 50. End portion 12' of the belt is threaded between bar 50 and inner loop 49 as shown in FIG. 9. Thereafter, the free end portion such as 13 shown in FIG. 1 is threaded first through loop 51 by passing under portion 52 and over portion 53 and thereafter the end portion 13 of the belt is passed over loop portion 54 and under loop portion 55, in the well known manner. As noted above, by selecting the position at which buckle 47 is mounted on belt end portion 12', the position of pocket 24 relative to the waist of the wearer can be adjusted.

Because of the foregoing construction of the improved holster belt 10 of the present invention, a plurality of advantages are obtained. First of all, there is practically complete concealment of the firearm because it is worn snugly against the side of the wearer. In addition, there is great comfort because of this snug fit and because of the fact that the circumferential position of the firearm can be adjusted. In addition, the belt 10, when not being used as a holster belt, can be worn as a regular belt and it is not discernible that it is a holster belt because outwardly it looks just like a regular belt, especially considering that band 15 which forms the pocket in conjunction with belt portion 11 is of substantially the same width as belt portion 11. The only outward indication that the belt may also be used as a holster lies in the fact that it has the extra stitching and the rivets, and possibly a snap portion such as 34 on the outside if the latter is used. However, if the belt has a tooled surface or a surface having a design, the structural features of the holster portion of the belt blend right into the design and become practically imperceptible. In addition to the foregoing features, the holster belt provides a high degree of safety because the side arm does not dangle but is held snugly against the body. In addition, the specific pocket such as shown, without modification, can carry all types of automatics having small, medium and large frames and can also carry revolvers having small, medium and large frames.

It can thus be seen that the improved holster belt of the present invention is manifestly capable of achieving the above enumerated objects and while preferred embodiments of the present invention have been disclosed, it will be appreciated that the present invention is not limited thereto but may be otherwise embodied within the scope of the following claims.

What is claimed is:

1. A combined holster belt construction for a side arm comprising an elongated belt member for encircling the waist of a wearer in a horizontal direction, band means, and spaced attaching means for securing laterally spaced portions of said band means to said belt member to define a loop therewith which is open at the top and bottom, said spaced attaching means effectively converging generally downwardly relative to each other to aid in retaining said side arm in position in said loop.

2. A holster belt as set forth in claim 1 wherein said band means is positioned on the inside of said belt member.

3. A holster belt as set forth in claim 2 wherein said attaching means comprises spaced lines of stitching and wherein one of said lines is curved so as to cause the portions of said belt member and said band means joined thereby to define a concave configuration for receiving the trigger guard of a firearm.

4. A holster belt as set forth in claim 1 including fastening means on opposite end portions of said belt member for securing said opposite end portions to each other, said fastening means including buckle means, and means mounting said buckle means so as to permit adjustable positioning thereof on said belt member.

5. A holster belt as set forth in claim 4 wherein said spaced attaching means comprise lines of stitching.

6. A combined holster belt for a side arm comprising an elongated belt member for encircling the waist of the wearer in a horizontal direction, band means, spaced attaching means fixedly attaching laterally spaced portions of said band means to said belt member to define a loop providing a vertical opening therewith open at the top and bottom to receive a side arm therein, said band means being mounted on the side of said belt member which faces the body of the wearer, and the length of said band means between said attaching means being shorter than the length of the portion of said belt member between corresponding portions of said attaching means.

7. A holster belt as set forth in claim 6 wherein said band means are of substantially the same width as said belt member.

8. A holster belt as set forth in claim 7 wherein said spaced attaching means converge generally downwardly relative to each other.

9. A holster belt as set forth in claim 8 including fastening means on opposite end portions of said belt member for securing said opposite end portions to each other, said fastening means including buckle means, and means mounting said buckle means so as to permit adjustable positioning thereof on said belt member.

10. A holster belt as set forth in claim 9 including a retaining strap, and securing means for securing said retaining strap to said belt member and said band means.

11. A holster belt as set forth in claim 6 and wherein said attaching means are of a configuration to cause said loop to approximate a trapezoid in side elevation.

12. A combined holster belt for a side arm comprising an elongated belt member for encircling the waist of the wearer in a horizontal direction, band means, spaced attaching means fixedly attaching laterally spaced portions of said band means to said belt member to define a loop providing a vertical opening therewith open at the top and bottom to receive a side arm therein, said band means being mounted on the side of said belt member which faces the body of the wearer, a retaining strap, and securing means for securing said retaining strap to said belt member and said band means.

13. A holster belt as set forth in claim 12 wherein said attaching means are of a configuration to cause said loop to approximate a trapezoid in side elevation.

* * * * *